US012510322B2

(12) United States Patent
Scheibel

(10) Patent No.: US 12,510,322 B2
(45) Date of Patent: Dec. 30, 2025

(54) WEAPON SYSTEM

(71) Applicant: KNDS DEUTSCHLAND GMBH & CO. KG, Munich (DE)

(72) Inventor: Axel Scheibel, Kassel (DE)

(73) Assignee: KNDS DEUTSCHLAND GMBH & CO. KG, Munich (DE)

( * ) Notice: Subject to any disclaimer, the term of this patent is extended or adjusted under 35 U.S.C. 154(b) by 0 days.

(21) Appl. No.: 18/872,929

(22) PCT Filed: Jun. 1, 2023

(86) PCT No.: PCT/DE2023/100414
§ 371 (c)(1),
(2) Date: Dec. 9, 2024

(87) PCT Pub. No.: WO2023/237156
PCT Pub. Date: Dec. 14, 2023

(65) Prior Publication Data

US 2025/0264292 A1 Aug. 21, 2025

(30) Foreign Application Priority Data

Jun. 10, 2022 (DE) ..... 10 2022 114 729.0

(51) Int. Cl.
*F41A 27/08* (2006.01)
*F41A 27/24* (2006.01)

(52) U.S. Cl.
CPC ..... *F41A 27/08* (2013.01); *F41A 27/24* (2013.01)

(58) Field of Classification Search
CPC ..... F41A 27/24; F41A 27/08
USPC ..... 89/41.01, 41.02, 41.15
See application file for complete search history.

(56) References Cited

U.S. PATENT DOCUMENTS

| | | | | |
|---|---|---|---|---|
| 5,062,347 | A * | 11/1991 | Allais | F41A 27/08 89/37.07 |
| 6,453,792 | B1 * | 9/2002 | Hampton | F41A 27/10 89/37.07 |
| 8,794,120 | B2 | 8/2014 | Kohnen | |
| 9,121,667 | B1 | 9/2015 | Kohnen | |
| 2018/0224062 | A1 | 8/2018 | Yokiel | |

FOREIGN PATENT DOCUMENTS

| | | | | |
|---|---|---|---|---|
| AT | 15795 | U1 | 7/2018 | |
| DE | 3207138 | C2 | 11/1985 | |
| DE | 3843258 | A1 * | 7/1990 | F41A 23/20 |
| EP | 2344833 | B1 | 7/2011 | |
| GB | 2131928 | A | 6/1984 | |

(Continued)

OTHER PUBLICATIONS

European Patent Office, International Search Report (with English translation), International Application No. PCT/DE2023/100414, 7 pages, Aug. 18, 2023.

(Continued)

*Primary Examiner* — Bret Hayes
(74) *Attorney, Agent, or Firm* — Thompson Hine LLP

(57) ABSTRACT

A weapon system with a weapon, and an aiming device with two spaced-apart elevation axes for aiming the weapon in elevation. The aiming device has a trunnion bearing associated with one elevation axis and a loose bearing associated with the other elevation axis for mounting a weapon mount receiving the weapon.

15 Claims, 4 Drawing Sheets

(56) References Cited

FOREIGN PATENT DOCUMENTS

| | | | |
|---|---|---|---|
| GB | 2140537 | A | 11/1984 |
| WO | 9849513 | A1 | 11/1998 |
| WO | 2010051902 | A1 | 5/2010 |
| WO | 2016020558 | A1 | 2/2016 |
| WO | 2017076388 | A1 | 5/2017 |
| WO | 2018073461 | A1 | 4/2018 |

OTHER PUBLICATIONS

WIPO, International Preliminary Report On Patentability, issued Dec. 19, 2024, which pertains to PCT Application No. PCT/DE2023/100414. 8 pages.

* cited by examiner

WEAPON SYSTEM

This application is a national stage filing of International (PCT) Application No. PCT/DE2023/100414, corresponding to International Publication No. WO 2023/237156, filed on Jun. 1, 2023, which in turn claims priority to German Application No. 10 2022 114 729.0 filed on Jun. 10, 2022. The entire contents of both of those applications are hereby incorporated by reference.

The disclosure relates to a weapon system with a weapon, in particular a barrel weapon, and an aiming device with two spaced-apart elevation axes for aiming the weapon in elevation. A further subject of the disclosure is a method for aiming the weapon of such a weapon system.

BACKGROUND

Numerous weapon systems are known from the military sector, such as artillery systems or battle tanks, which have a weapon, in particular a large-caliber barrel weapon, to fight the respective target. Such weapon systems usually have an aiming device for aiming the weapon, by means of which the weapon can be aimed both about a vertical azimuth axis and about a horizontal elevation axis in a weapon receptacle at the weapon system, often also referred to as a weapon cradle. For aiming in elevation, trunnion mounts are generally used in which the weapon barrel is mounted so that it can be aimed around a trunnion extending along the elevation axis. In such trunnion mounts, the weapon barrel extends essentially in the firing direction in front of the trunnion in the direction of the barrel muzzle. Depending on the configuration, various other weapon components, such as the breech end for feeding the ammunition, a barrel brake and recuperator system, are arranged in the firing direction behind the trunnion in such weapon systems.

In such weapon systems, the elevation aiming range of the weapon generally extends over a positive aiming range that is located higher than the horizontal line in order to be able to fight targets with direct or indirect fire. Furthermore, the elevation aiming range can also extend over a negative aiming range inclined downwards in relation to the horizontal line, sometimes also referred to as weapon depression, for example to be able to fight lower-lying targets or targets close to the weapon in sloping terrain from an elevated position, or similar.

In this context, due to the weapon components extending over a certain length behind the trunnion and the resulting barrel recoil when firing, i.e. a movement of the weapon barrel against the firing direction, it may be disadvantageous that such weapon systems also require a large amount of space below the elevation axis when aiming the weapon in elevation. This space requirement also increases with the size of the positive aiming range. In practice, this means that the turret trunnion has to be positioned relatively high above the turret base in the vertical direction, for example, in order to create sufficient space for the weapon components positioned behind the trunnion and the barrel recoil even when the weapon barrel is aimed upwards as far as possible. As a starting position for aiming such a weapon in the negative aiming range, the elevated arrangement of the trunnion may be disadvantageous, as in this case there is an additional increased space requirement behind the trunnion for the weapon components arranged behind the trunnion and pivoted upwards when aiming in the negative elevation aiming range. This can therefore result in comparatively space-consuming turret designs, especially when considering its rotational contour, and thus lower performance densities of the weapon system.

In addition to these classic trunnion mountings, which have been in widespread use for several decades, there are also a few alternative aiming devices for barrel weapons that allow the corresponding weapons to be aimed about more than one elevation axis. For example, AT 15 795 U1 describes a weapon system with a barrel weapon that can be aimed about two spaced-apart elevation axes using an articulated linkage. With these weapon systems, it may be a disadvantage that the aiming movements of the weapon connected to the articulated linkage are kinematically complex and require complex control.

SUMMARY

Against this background, the present disclosure sets itself the problem of providing a weapon system and a method for aiming a weapon in elevation, which are characterized by a high performance density with simultaneous simple control.

This problem is addressed in one case in a weapon system of the type mentioned at the beginning by the features of claim 1. Further embodiments are given in the dependent claims.

The aiming device has a trunnion bearing associated with one elevation axis and a loose bearing associated with the other elevation axis for mounting a weapon receptacle that receives the weapon. Such an arrangement with a trunnion bearing and a loose bearing allows for a simple and trouble-free aiming of the weapon in elevation. The loose bearing assigned to the one elevation axis can enable a relative movement of the weapon with respect to the associated elevation axis in the firing direction and, in particular, also a corresponding relative movement of the trunnion bearing with respect to the loose bearing. Furthermore, such an arrangement enables several suitable starting positions for aiming the weapon both in the positive and in the negative elevation angle range, which differ by different positions of the trunnion bearing and/or the loose bearing in the vertical direction. This makes it possible to reduce the installation space of the weapon system required for the aiming movements and the system-related barrel recoil, which means that an increased performance density can be achieved.

In a further development, it is proposed that the loose bearing is arranged in front of the trunnion bearing in the firing direction of the weapon. Such an arrangement permits aiming of the weapon in elevation. In an alternative arrangement, however, the loose bearing can also be arranged behind the trunnion bearing in the firing direction of the weapon if this should prove to be useful for the operation of the aiming device of the weapon system.

In this context, it is also proposed that the loose bearing is arranged in the firing direction of the weapon in a front area of the weapon receptacle and/or that the trunnion bearing is arranged in the firing direction of the weapon in a rear area of the weapon receptacle. Such an arrangement can enable a mechanically advantageous, defined mounting of the weapon receptacle with reliable force transmission via the trunnion bearing, whereby the aiming in elevation can be carried out precisely and accurately repeatable. In this context, however, the trunnion bearing in the firing direction of the weapon can also be arranged in a front area of the weapon receptacle and/or the loose bearing in the firing direction of the weapon can be arranged in a rear area of the weapon receptacle if this proves to be useful for the respective application.

In a further development, it is further proposed that the trunnion bearing is arranged in the region of one of the rear weapon components of the weapon, in particular in the region of a rear end of the barrel brake and recuperator system in the firing direction of the weapon. Such an arrangement of the trunnion bearing allows the weapon to be easily aimed in elevation. The trunnion bearing also allows a reliable absorption of the firing reaction forces occurring in the area of the barrel brake and recuperator system. Alternatively, it is also conceivable in this context to arrange the trunnion bearing in the area of the weapon barrel if desired.

An embodiment provides for the trunnion bearing and/or the loose bearing to be arranged rotatably along an orbit around the associated elevation axis. Such an arrangement enables a simple and reliable elevation of the weapon in a small space. In particular, the rotatable arrangement of the trunnion bearing and/or the loose bearing along an orbit around the associated elevation axis allows both flexible and precise aiming in elevation. Furthermore, such an arrangement allows a large aiming range to be covered, which can be adjusted via the aiming device.

In this context, it may be advantageous if the radius of the orbit of the trunnion bearing around the one elevation axis is essentially the same as the radius of the orbit of the loose bearing around the other elevation axis. Such an arrangement may be further advantageous with regard to a robust and user-friendly adjustment of the aiming angle in elevation. Furthermore, such an arrangement of the orbits allows a particularly space-saving design of the aiming device, as the same amount of space is required for both aiming devices, particularly in the vertical direction. However, in order to adapt the aiming range, it may also be advantageous if the radius of the orbit of the trunnion bearing around the one axis of elevation is not equal to the radius of the orbit of the loose bearing around the other axis of elevation.

In a further development, it is proposed that the trunnion bearing and/or the loose bearing are arranged to be rotatable over an angular range about the associated elevation axes which is smaller than 360°. The limitation of the respective angular range simplifies the control of the aiming device. In this context, it may be particularly useful if the angular range in which the trunnion bearing and/or the loose bearing are arranged rotatably about the associated elevation axes is less than 180°, and more particularly less than 90°. Limiting the angular range in this way also makes it possible to achieve a compact design with a simple control of the aiming device.

In this context, it is also proposed that the elevation axes can be controlled independently of one another for the purpose of aiming the weapon. Such independent controllability of the elevation axes increases the flexibility of the aiming device, since either both elevation axes can be controlled together or individually for aiming. In conjunction with the loose bearing, such an arrangement also allows the weapon to be aimed in the event that the control of one of the elevation axes has failed. This certain redundancy can further increase the performance of the weapon system.

From a design point of view, in one case the trunnion bearing has at least two trunnion bearing points between which the weapon receptacle is mounted and/or that the loose bearing has at least two loose bearing points between which the weapon receptacle is mounted. This type of mounting of the weapon receptacle between two bearing points may be advantageous with regard to a robust, low-disturbance mounting of the weapon receptacle. Firing reaction forces can be dissipated via the two bearing points and symmetrically over both sides of the weapon.

One embodiment provides for the aiming device to have at least one pivot element for aiming the weapon, which can be pivoted via at least one aiming drive. Such an arrangement enables the weapon to be quickly aimed in elevation. In particular, the at least one pivot element that can be pivoted via the aiming drive can be pivoted in such a way that the trunnion bearing and/or the loose bearing are rotated along the orbit about the respective associated elevation axis. Such an aiming drive can be designed in the manner of a crank, piston or eccentric drive, for example.

From a design point of view, it may be advantageous in this context if the aiming device has at least two pivot elements for aiming the weapon, each of which can be pivoted via at least one aiming drive and each of which is assigned an elevation axis. Such an arrangement enables particularly user-friendly, fast and repeatable aiming of the weapon over a large aiming range by pivoting the pivot elements by means of the aiming drives.

In this context, it is further proposed that one of the pivot elements extends between the one elevation axis and the trunnion bearing and/or that another pivot element extends between the other elevation axis and the loose bearing. Such an arrangement makes it possible for the trunnion bearing to be rotated by pivoting the one pivot element about the one elevation axis and for the loose bearing to be rotated by pivoting the other pivot element about the other elevation axis. By pivoting the pivot elements, the trunnion bearing and/or the loose bearing can be rotated about the orbits around the elevation axes. This may result in user-friendly, easily controllable aiming in elevation. The radial length of the pivot elements can be the same. This makes it easy to create orbits of the same radius for the two bearing points.

With regard to a low-wear design of the aiming device, it is proposed that the pivot elements can be decoupled from the aiming drive. Such a design can ensure that the firing reaction forces acting on the pivot elements via the weapon are not transferred to the aiming drive. This can increase the service life of the aiming drive. In this context, it is also proposed that the pivot elements can be fixed in the pivot position set via the aiming drive in such a way that the firing reaction forces are not transferred via the drive. In this case, the pivot elements are in the force flow and the aiming drives are outside the force flow.

From a design point of view, it may be useful if the pivot element is a pivot rod or a pivot disk. Such a design of the pivot element as a pivot rod or pivot disk may be advantageous with regard to a low-disturbance, easily controllable rotation of the loose bearing and/or the trunnion bearing about the elevation axes.

It also may be advantageous in terms of design if a pivot element designed as a pivot disk is at least partially circular, in particular circular sector-shaped, with a radius. In this context, it is proposed that the pivot element has a circular sector shape, with the circular sector extending in the circumferential direction in particular over less than 180°, in one case less than 90°. This allows the aiming movements to be accelerated with the same aiming drives, which can also further increase the performance density of the weapon system.

In a further development, it is proposed that the trunnion bearing and/or the loose bearing are arranged on the outer circumference of the respective pivot elements designed as pivot disks. Such an arrangement allows the trunnion bearing and/or the loose bearing to be rotated about the respective assigned elevation axis along the orbits in a particularly simple and robust manner by pivoting the respective pivot elements designed as pivot disks. Furthermore, such an arrangement makes it possible to maximize the adjustable aiming range via the aiming device.

In a further development, it is further proposed that the elevation axes are arranged at a predetermined distance from the turret base, with the distance from the turret base corresponding to the length of the pivot element designed as a pivot rod and/or the radius of the pivot element designed as a pivot disk. Such an arrangement allows the adjustable elevation angle to be maximized while considering the available free space of the turret.

Furthermore, a method for elevating a weapon of a weapon system, in particular a barrel weapon, with an aiming device having two spaced-apart elevation axes, wherein the aiming device has a trunnion bearing associated with one elevation axis and a loose bearing associated with the other elevation axis for mounting a weapon receptacle receiving the weapon, wherein the trunnion bearing and/or the loose bearing are rotated about the respective elevation axis for aiming the weapon is proposed for solving the aforementioned problem. Such a method for elevating the weapon enables the design of weapon systems with a high performance density and at the same time simple, error-free control of the aiming movements. Furthermore, the method of elevating a weapon by rotating the trunnion bearing and/or the loose bearing on an orbit around the respective elevation axis has proven to be particularly fast.

In connection with the method for elevating a weapon of a weapon system, it is further proposed that the weapon system is designed in accordance with one or more of the features described above. This can result in the advantages described in connection with the weapon system.

BRIEF DESCRIPTION OF THE DRAWINGS

Further details and advantages are explained below with the aid of the accompanying drawings of two embodiments.

DETAILED DESCRIPTION

Figure 1:
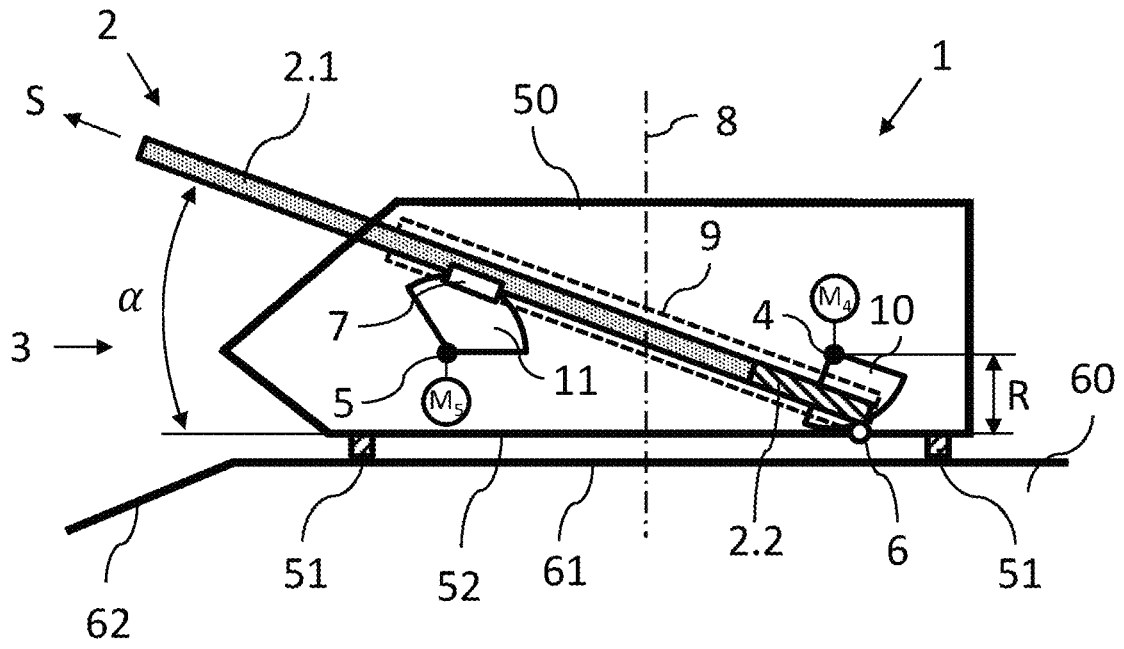
FIG. 1 is a schematic, sectional side view of a weapon system according to a first embodiment.

The illustrations in FIGS. 1 to 6*b* show a weapon system 1 in various, partly sectional and partly highly schematic illustrations.

The weapon system 1 is a self-propelled weapon system 1 in the form of a main battle tank. However, the weapon system 1 can also be another military weapon system 1, such as an infantry fighting vehicle, an artillery system, an air defense system or the like.

The weapon system 1 has a weapon 2, which in the present embodiment example is designed as a barrel weapon and is arranged on a turret 50 of the weapon system 1, which is designed as a main battle tank.

The weapon 2 is arranged on the weapon turret 50 so that it can be aimed in azimuth and elevation on the weapon system 1. To aim the weapon 2 in azimuth, the turret 50 is rotatably mounted via a turret pivot bearing 51 about the azimuth axis 8 running in the vertical direction, see FIG. 1. For aiming the weapon 2 in elevation, i. e. for setting an elevation angle $\alpha$ extending between the firing direction S of the weapon 2 and the horizontal line, the weapon system 1 has an aiming device 3 which has two elevation axes 4, 5 arranged at a horizontal distance X from each other, see FIG. 3.

The weapon system 1 is characterized by a high performance density, i.e. it has a high weapon performance at a comparatively small installation space and thus a comparatively low system weight. Furthermore, the weapon system 1 is characterized by a simple, robust control of the aiming device 3 for aiming the weapon 2 in elevation. This will be explained in more detail below, initially with reference to the illustration in FIG. 1.

The illustration in FIG. 1 shows the aiming device 3 for aiming the weapon 2 in elevation using an exemplary set elevation angle $\alpha$, which, according to the illustration in FIG. 1, lies in the upper positive aiming range of the weapon 2, which is raised in relation to the horizontal line. The aiming device 3 has the two elevation axes 4, 5, which are arranged at a distance from each other on the same horizontal plane and extend essentially horizontally and parallel to the turret base 52. According to the illustration, one of the elevation axes 4 is arranged in a rear area of the turret 50 in the azimuth direction and the other elevation axis 5 is arranged in a front area of the turret 50 in the azimuth direction. However, other arrangements of the elevation axes 4, 5 relative to the turret 50 are also conceivable, for example the elevation axes 4, 5 can also extend on different horizontal planes if this should prove to be useful due to the other structural conditions of the weapon system 1.

Figure 2:
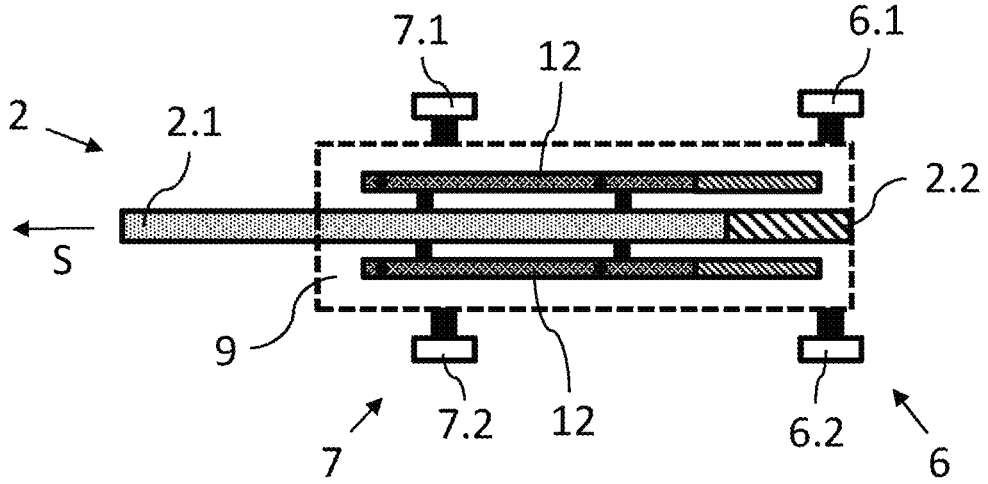
FIG. 2 is a schematic top view of the aiming device of the weapon system as shown in FIG. 1.

Prior to explaining the structure and function of the aiming device 3 for aiming in elevation in detail, the mounting of the weapon 2 at the aiming device 3 is first explained using the illustrations in FIGS. 1 and 2. The weapon 2 is mounted in a weapon receptacle 9. The weapon receptacle 9 is designed in the manner of a weapon cradle that at least partially encloses the weapon 2 around its circumference. The weapon receptacle 9 can have an essentially U-shaped or C-shaped cross-section, in the opening of which the weapon 2 is held. Alternatively, for reasons of rigidity, for example, the weapon receptacle 9 can also have a closed, for example square or rectangular cross-section, in the opening of which the weapon 2 is received. As can be seen from the schematic illustrations in FIGS. 1 and 2, the weapon 2 is not completely accommodated along its length in the weapon receptacle 9, but an area of the weapon barrel 2.1 oriented in the direction of the weapon muzzle is located outside the weapon receptacle 9. In the opposite direction, the weapon receptacle 9 is adapted to the length of the barrel recoil 2.2 of the weapon 2. Alternatively, however, the weapon receptacle 9 can also be shorter and the weapon recoil 2.2 can extend beyond the end of the weapon receptacle 9. In this case, care must be taken to ensure that sufficient space remains behind the weapon receptacle 9 even when the weapon barrel 2.1 is maximally elevated, so that the weapon barrel 2.1 can return unhindered when the shot is fired.

The weapon receptacle 9, which holds the weapon 2, is mounted on the aiming device 3 so that it can be elevated via two elevation axes 4, 5. For this purpose, the aiming device 3 has a trunnion bearing 6 assigned to one elevation axis 4 and a loose bearing 7 assigned to the other elevation axis 5, see FIG. 1. The trunnion bearing 6 allows rotational movements of the weapon receptacle 9 in the manner of a joint, while the loose bearing 7 allows translational movements of the weapon receptacle 9 in or against the firing direction S.

According to the plan view in FIG. 2, the trunnion bearing 6 assigned to one elevation axis 4 has two trunnion bearing points 6.1, 6.2 spaced apart in the horizontal direction and the loose bearing 7 assigned to the other elevation axis 5 has two loose bearing points 7.1, 7.2 spaced apart in the horizontal direction, between which the cradle-like weapon receptacle 9 is mounted. According to the illustration in FIG. 2, the weapon 2 also has a weapon support system 12, which may include a barrel brake system, a barrel recuperator system or similar components, which extends essentially parallel to the weapon barrel 2.1 on both sides and is also accommodated by the weapon receptacle 9. As can be seen from the illustration in FIG. 2, the weapon 2 also has a barrel recoil 2.2 extending in the axial direction behind the weapon barrel 2.1 in the firing direction S, shown hatched in FIG. 2. The barrel recoil 2.2 is a free space behind the weapon barrel 2.1, into which the weapon barrel 2.1 moves as a result of the firing reaction forces that occur when the shot is fired. Depending on the design of the weapon 2, further weapon components can be arranged completely or partially to the side of the barrel recoil 2.2.

As can be seen from the illustration in FIG. 2, the trunnion bearing 6 is arranged in the area of the barrel recoil 2.2 on the weapon receptacle 9, in particular in the area of the rear end of the weapon receptacle 9. This arrangement allows particularly reliable absorption of the firing reaction forces introduced via the weapon 2 into the weapon receptacle 9 via the spherical bearing 6. Furthermore, the weapon 2 is particularly well guided during elevation by this arrangement of the spherical bearing 6. The loose bearing 7 is arranged in front of the spherical bearing 6 in the firing direction S of the weapon 2, in a front area of the weapon receptacle 9.

Figure 3:
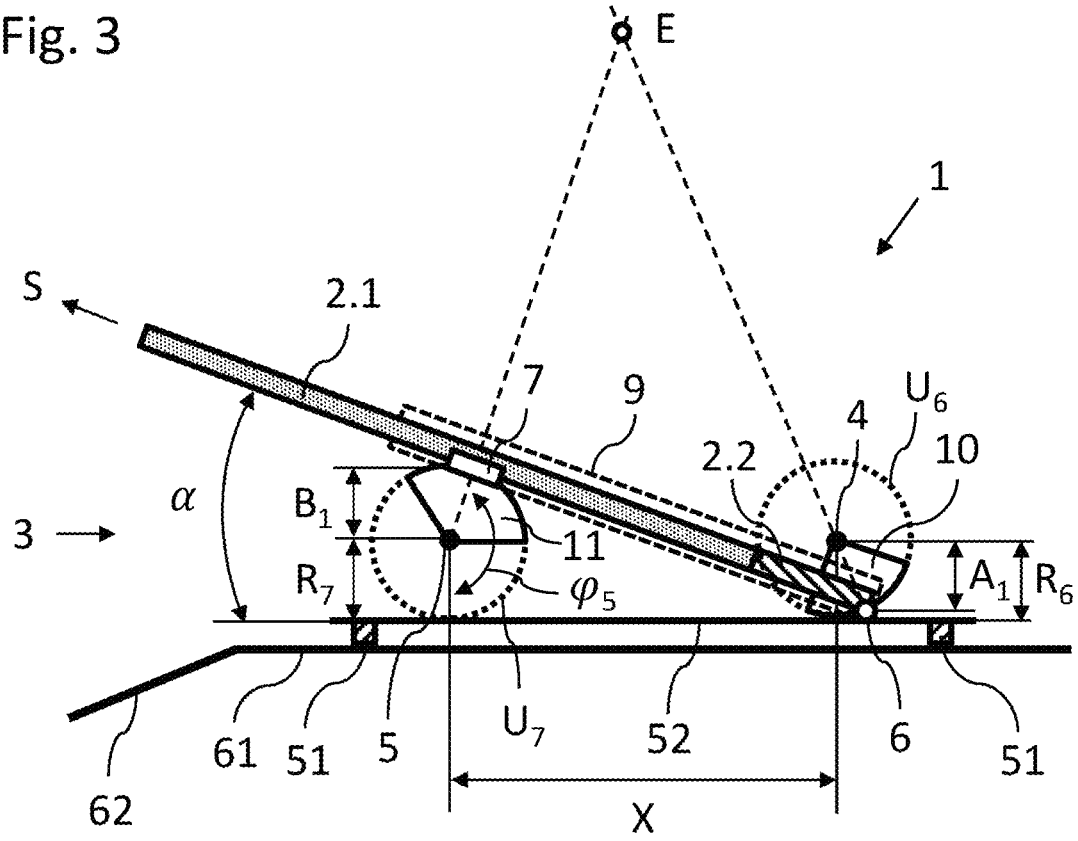
FIG. 3 is a further schematic, sectional side view of the weapon system as shown in FIG. 1 in a first elevation position.

The following illustration in FIG. 3 explains how the weapon 2, which is mounted on the aiming device 3 via the weapon receptacle 9, can be aimed in elevation by means of the aiming device 3. For this purpose, the trunnion bearing 6 supporting the weapon receptacle 9 and the loose bearing 7 are each arranged to rotate along a circular orbit $U_6$, $U_7$ around the respective associated elevation axis 4, 5, see also FIG. 1. When the weapon 2 is aimed, the two bearings are therefore moved along the orbits $U_6$, $U_7$. The elevation angle $\alpha$ of the weapon 2 can be adjusted via the respective orbital position of the trunnion bearing 6 around the elevation axis 4 and the loose bearing 7 around the elevation axis 5 (each described by the rotation angle $\varphi_4$ or $\varphi_5$ relative to the vertical, see FIGS. 6*a* and *b*) and the weapon 2 can therefore be aimed in elevation. In the orbital position according to FIG. 3, the trunnion bearing 6 arranged in a rear area of the weapon receptacle 9 is arranged on the orbit $U_6$ around the elevation axis 4 below the elevation axis 4, close to the turret base 52. At the same time, the loose bearing 7 is arranged above the associated elevation axis 5 in an area of the orbit $U_7$ around the elevation axis 5 remote from the turret base 52. This results in a positive elevation angle $\alpha$ of the weapon 2.

In order to move the trunnion bearing 6 and the loose bearing 7 about the respective associated elevation axis 4, 5, the aiming device 3 has a respective pivot element 10, 11 extending between the respective elevation axis 4, 5 and the trunnion bearing 6 or the loose bearing 7, see FIG. 1. The two pivot elements 10, 11 are designed according to FIG. 1 in the manner of circular sector-shaped pivot disks having the radius R. The radius $R_6$ or $R_7$ of the pivot elements 10, 11 corresponds to the radius of the orbit $U_6$, $U_7$ of the trunnion bearing 6 or the loose bearing 7 around the respective elevation axis 4, 5, see FIG. 3. The pivot element 10 assigned to the trunnion bearing 6 extends over an angle of approx. 90° and thus forms approximately a quarter circle sector. The pivot element 11 associated with the loose bearing 7 extends over an angle of approximately 120° and thus forms approximately one third of a circle sector. Alternatively, the pivot elements 10, 11 can also extend over other circular angles, for example over semi-circular sectors or even full circles. The trunnion bearing 6 and the loose bearing 7 are arranged on the outer circumference of the respective pivot elements 10, 11, see FIG. 3. When the pivot elements 10, 11 pivot about the respective associated elevation axis 4, 5, the trunnion bearing 6 and the loose bearing 7 thus perform a rotary movement at a distance R from the elevation axis 4, 5. In other words, the pivoting of the circular sector-shaped pivot elements 10, 11 by the rotation angle $\varphi_4$, $\varphi_5$ causes a rotational movement of the trunnion bearing 6 or loose bearing 7 arranged at their outer circumference on the respective orbit $U_6$, $U_7$ by the same rotation angle $\varphi_4$, $\varphi_5$, see also FIG. 6*a-b*.

Figure 4:
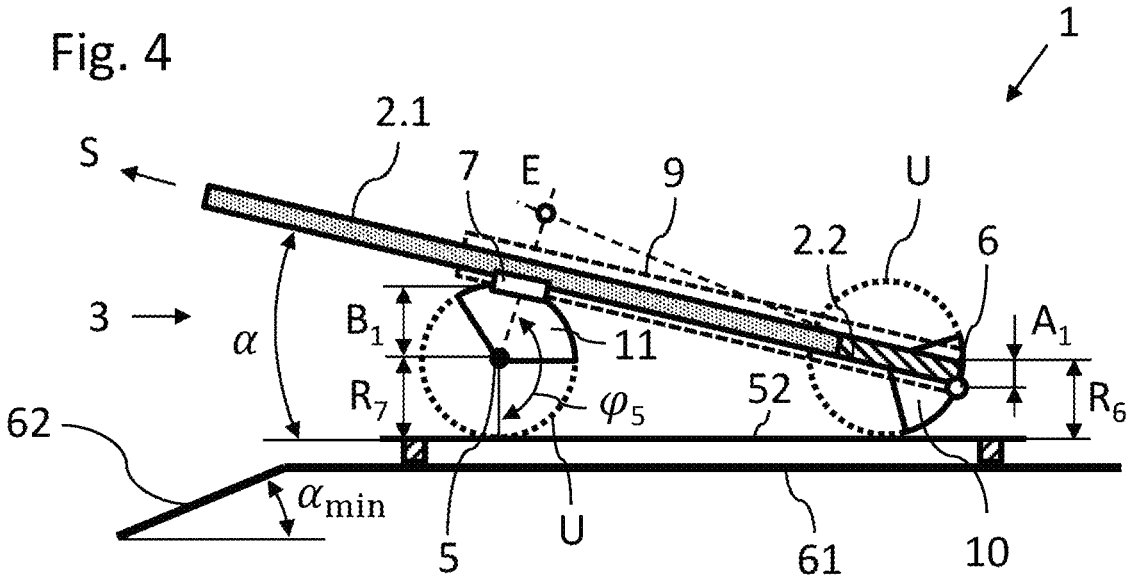
FIG. 4 is a further schematic, sectional side view of the weapon system as shown in FIG. 1 in a second elevation position.

As can be seen, for example, from the illustrations in FIG. 3 or 4, the pivot elements 10, 11, which are designed as circular sector-shaped pivot discs, have the same radius $R_6$, $R_7$. This results in the same orbits $U_6$, $U_7$ for the trunnion bearing 6 and the loose bearing 7 around the respective associated elevation axis 4, 5. Such an arrangement may be advantageous in terms of simple control of the aiming device 3. Alternatively, the pivot elements 10, 11 can also have different radii R, which can increase the aiming range, for example.

At least one aiming drive $M_4$, $M_5$ designed as a motor is provided to drive each of the pivot elements 10, 11, see FIG. 1. The aiming drives $M_4$, $M_5$ can be used to pivot the respective pivot element 10, 11 quickly and accurately repeatable by the respective rotation angle $\varphi_4$, $\varphi_5$ around the respective elevation axis 4, 5. The aiming drives $M_4$, $M_5$ can be controlled independently of each other, which increases the flexibility of the aiming device 3, as the pivot elements 10, 11 can be pivoted independently around the respective elevation axis 4, 5.

When comparing the illustrations in FIG. 3 and FIG. 4, it can be seen that the loose bearing 7 arranged on the outer circumference of the pivot element 11 is positioned at the same rotation angle $\varphi_5$ relative to the elevation axis 5 in both figures. According to the illustration in FIG. 4, however, the trunnion bearing 6 is rotated by a certain rotation angle $\varphi$ counterclockwise around the elevation axis 4 compared to FIG. 3. This results in different rotation angles $\varphi_4$. The loose bearing 7 allows the resulting translational displacement of the weapon barrel 2.1. The result is a slightly smaller elevation angle $\alpha$. To relieve the aiming drives $M_4$, $M_5$ from the firing reaction forces, they can be decoupled from the pivot elements 10, 11 in such a way that the forces are not transmitted via the aiming drives $M_4$, $M_5$. A fixing device, not shown in the figures, is provided for this purpose, which fixes the pivot elements 10, 11 in the respective pivot position set via the aiming drives $M_4$, $M_5$ and renders the aiming drives $M_4$, $M_5$ powerless.

As can be seen from the illustrations in FIGS. 3 and 4, the aiming movements of the trunnion bearing 6 and the loose bearing 7 about the two elevation axes 4, 5 can be traced back to a aiming movement of the weapon receptacle 9, which is mounted via the trunnion bearing 6 and the loose bearing 7, about a single, virtual elevation pole E. This virtual elevation pole E can be displaced and adjusted in space by the interacting rotational movements of the trunnion bearing 6 and the loose bearing 7 about the two elevation axes 4, 5. By elevating the weapon 2 around the virtual elevation pole E, a large positive and negative aiming range can be achieved. The aiming device 3 is considerably smaller, particularly in the vertical direction, than would be the case if aiming were to be performed around a single, real elevation axis with the same large aiming range. Due to the smaller size of the aiming device 3, the turret 50 can also be smaller and thus lighter, which increases the performance density of the weapon system 1 and thus also its technical and tactical performance.

Figure 6A:
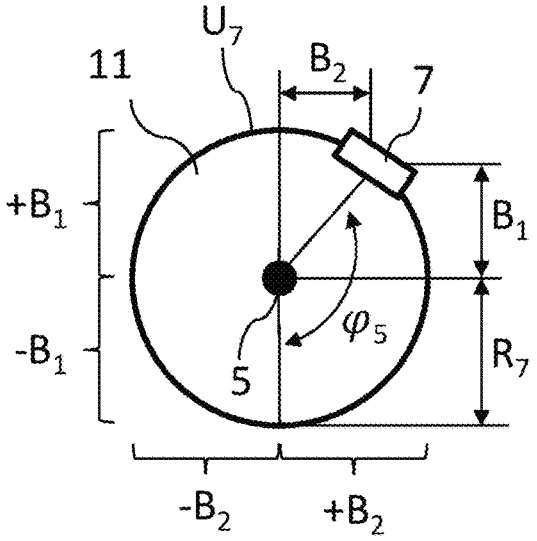
FIG. 6*a* is a principle view of an elevation axis.
Figure 6B:
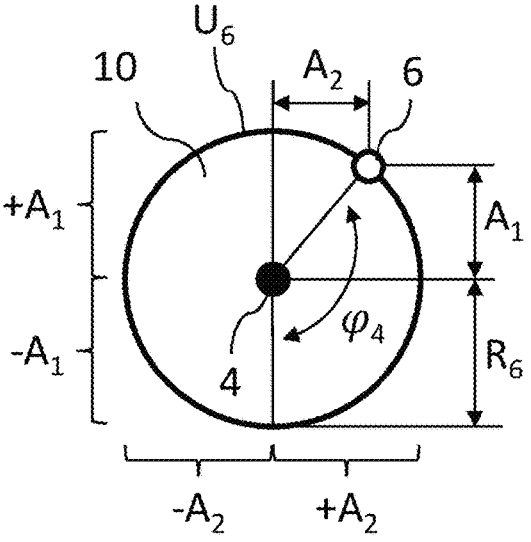
FIG. 6*b* is a principle view of another elevation axis.

The illustrations in FIG. 6*a*, which schematically shows a section of the aiming device 3 limited to the elevation axis 5, and FIG. 6*b*, which schematically shows a section of the aiming device 3 limited to the elevation axis 4, can be used to explain in detail how aiming in elevation takes place via the rotary movements of the trunnion bearing 6 or the loose bearing 7 about the respective elevation axis 4, 5. As already explained above, pivoting the pivot elements 10, 11 by the rotation angle $\varphi_4$, $\varphi_5$ around the respective elevation axis 4, 5 changes the rotational position of the trunnion bearing 6 or the loose bearing 7, whereby these perform a rotational movement on the orbit $U_6$, $U_7$ determined by the radius $R_6$, $R_7$ of the respective pivot element 10, 11. In an alternative approach, the rotation of the trunnion bearing 6 and the loose bearing 7 by the rotation angle $\varphi_4$, $\varphi_5$ changes the vertical distances $A_1$, $B_1$ and the horizontal distances $A_2$, $B_2$ of the elevation axes 4, 5 to the trunnion bearing 6 and the loose bearing 7, respectively, see FIGS. 6*a* and *b*. The aiming position can thus be described both via the rotation angles $\varphi_4$, $\varphi_5$ and via the distances $A_1$, $B_1$, $A_2$, $B_2$.

The illustrations in FIGS. 5*a* to *e* exemplify a possible range of aiming positions of the weapon 2 with the aiming device 3 described above, whereby the weapon receptacle 9 is not shown for the sake of simplicity. In the schematic illustrations of the exemplary embodiment shown in FIGS. 5*a* to *e*, the weapon 2 with the weapon barrel 2.1 as well as the trunnion bearing 6 and the loose bearing 7 of the aiming device 3, via which the weapon 2 (via the weapon receptacle 9 not shown) is mounted for elevation, are each shown in a very simplified manner. The trunnion bearing 6 is arranged in the firing direction S in the rear area of the weapon 2 on the outer circumference of a pivot disk 10, which can pivot around the elevation axis 4 and is designed as a full circular disk for illustration purposes. The loose bearing 7 is arranged in the firing direction S in front of the trunnion bearing 6 on the outer circumference of a pivot disk 11 that can pivot around the elevation axis 5 and is also designed as a full circular disk for illustration purposes.

Figure 5A:
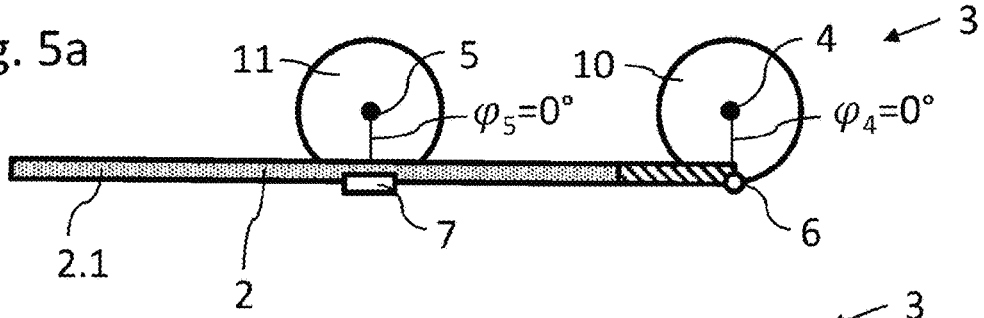
FIG. 5*a* is a more schematized view of a further embodiment of a weapon system with a weapon in a first elevation position.

The illustration in FIG. 5*a* shows a transport position of the weapon 2. For this purpose, the weapon 2 is brought into a lower position close to the turret base via the aiming system 3. In this position, the weapon 2 extends parallel to the turret base 52. The trunnion bearing 6 and the loose bearing 7 are each rotated to a lower position, the rotation angle $\varphi_4$, $\varphi_5$ is 0° in each case. The transport position of the weapon 2 is characterized by a low overall height of the aiming device 3 and thus of the weapon system 1. This advantage may be particularly noticeable with circular sector-shaped or pivot rod-shaped pivot elements 10, 11, see for example FIGS. 3, 4. Furthermore, the weapon 2 is closer to the ground, which shifts the center of gravity of the weapon system 1 downwards in an useful manner.

Figure 5B:
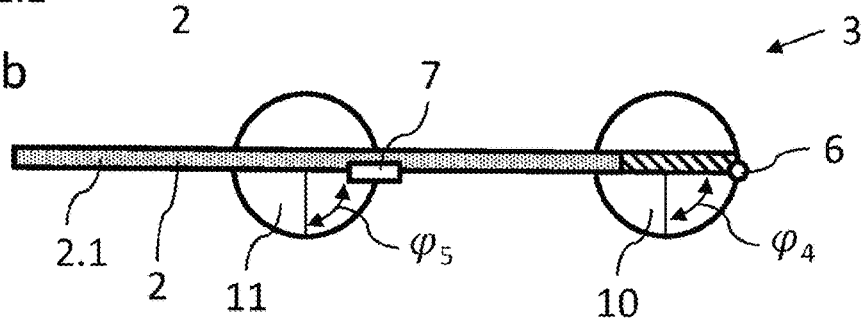
FIG. 5*b* is a more schematized view of a further embodiment of a weapon system with a weapon in a second elevation position.

According to the illustration in FIG. 5*b*, the aiming device 3 is in a neutral position in which the weapon barrel 2.1 of the weapon 2 is aligned essentially parallel to the turret base 52. The elevation angle $\alpha$ is therefore 0°. In the neutral position, which represents a starting position for the aiming movements, both the trunnion bearing 6 and the loose bearing 7 each have the same rotation angle $\varphi_4$, $\varphi_5$ about the respective elevation axis 4, 5 and are at approximately the same vertical height as the elevation axes 4, 5. The rotation angle $\varphi_4$, $\varphi_5$ is approximately 90° in each case.

Figure 5C:
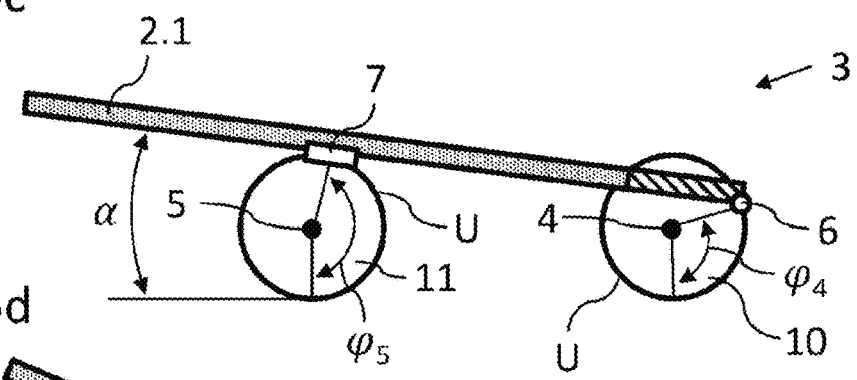
FIG. 5*c* is a more schematized view of a further embodiment of a weapon system with a weapon in a third elevation position.

By pivoting the pivot elements 10, 11 out of the neutral position, the elevation angle $\alpha$ can be adjusted as required within an upper limit $\alpha_{max}$ and a lower limit $\alpha_{min}$, compare FIG. 5*c* for example. According to the illustration in FIG. 5*c*, there is a positive elevation angle $\alpha$, which was achieved by rotating the trunnion bearing 6 and the loose bearing 7 by a certain rotation angle $\varphi$ counterclockwise from the neutral position. The rotation angles $\varphi_4$, $\varphi_5$ have different amounts.

Figure 5D:
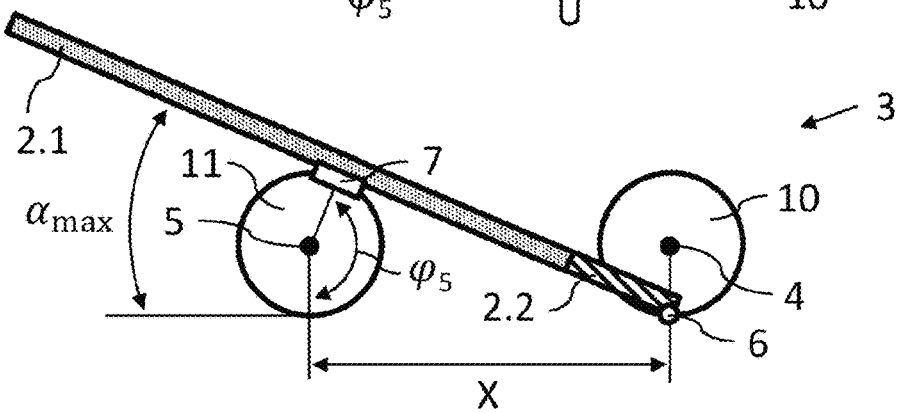
FIG. 5*d* is a more schematized view of a further embodiment of a weapon system with a weapon in a fourth elevation position.

To set the maximum elevation angle $\alpha_{max}$ as shown in FIG. 5*d*, the trunnion bearing 6 is rotated to a lower rotational position and the loose bearing 7 is rotated to an upper rotational position. The maximum elevation angle $\alpha_{max}$ can be influenced by the dimensions of the pivot elements 10, 11 and the arrangement of the elevation axes 4, 5. Based on the illustration in FIG. 5*d*, it can be seen that the maximum elevation angle $\alpha_{max}$ could be further increased if the distance X between the elevation axes 4, 5 were reduced. Alternatively, the radius R of the pivot element 10 or the pivot element 11 could also be increased, for example, to enable larger maximum elevation angles $\alpha_{max}$ or similar.

Figure 5E:
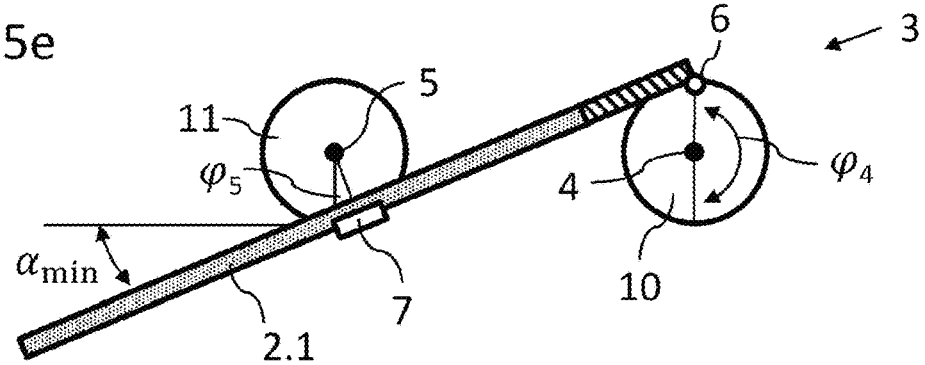
FIG. 5*e* is a more schematized view of a further embodiment of a weapon system with a weapon in a fifth elevation position.

As shown in FIG. 5*e*, the aiming device 3 can also be used to set negative elevation angles $\alpha$, for example to fight targets that are located at lower positions or very close to the weapon system 1. To set the minimum elevation angle $\alpha_{min}$, the trunnion bearing 6 is rotated to an upper position. The loose bearing 7 is also rotated to a lower position. The minimum elevation angle $\alpha_{min}$ is influenced not only by the dimensions of the pivot elements 10, 11 and the arrangement of the elevation axes 4, 5, but also in particular by the design of the hull 60 arranged below the tower 50, see FIG. 4. The hull slope 62 of the hull roof 61 limits the minimum elevation angle $\alpha_{min}$.

A method for elevating the weapon 2 is described below using the illustration in FIGS. 3 and 4: Starting from the elevation angle $\alpha$ set according to FIG. 4, the elevation angle $\alpha$ shown in FIG. 3 is to be set via the aiming device 3. For this purpose, the trunnion bearing 6, which is arranged on the outer circumference of the circular sector-like pivot element 10, is rotated around the elevation axis 4. Rotation about the rotation angle $\varphi_4$ is performed via an aiming drive $M_4$ (see FIG. 1), by means of which the pivot element 10 is pivoted about the same rotation angle $\varphi_4$. The loose bearing 6 assigned to the other elevation axis 5 can also be rotated by pivoting the pivot element 11, but in this example, it remains in its rotational position as shown in FIG. 4. The rotation of the trunnion bearing 6 moves the weapon receptacle 9, which is connected to it in a rear area and holds the weapon 2, in a horizontal and vertical direction in such a way that a smaller elevation angle $\alpha$ results.

The weapon system 1 described above and the method for elevating a weapon 2 of a weapon system 1 are characterized by a high performance density with simultaneous simple control of the aiming device 3.

REFERENCE SIGNS

1 Weapon system
2 Weapon
2.1 Weapon barrel
2.2 Barrel recoil
3 Aiming device
4 Elevation axis
5 Elevation axis
6 Trunnion bearing
6.1 Trunnion bearing point
6.2 Trunnion bearing point
7 Loose bearing
7.1 Loose bearing point
7.2 Loose bearing point
8 Azimuth axis
9 Weapon receptacle
10 Pivot element
11 Pivot element
12 Weapon support system
50 Turret
51 Turret pivot bearing
52 Turret base
60 Hull
61 Hull roof
62 Hull slope
$A_1$ Vertical distance
$A_2$ Horizontal distance
$B_1$ Vertical distance
$B_2$ Horizontal distance
E Elevation pole
M Aiming drive
$M_4$ Aiming drive
$M_5$ Aiming drive
R Radius
$R_6$ Radius
$R_7$ Radius
S Firing direction
U Orbit
$U_6$ Orbit
$U_7$ Orbit
X Distance
$\alpha$ Elevation angle
$\alpha_{max}$ Maximum elevation angle
$\alpha_{min}$ Minimum elevation angle
$\varphi$ Rotation angle
$\varphi_4$ Rotation angle
$\varphi_5$ Rotation angle Having described the invention in detail and by reference to the various embodiments, it should be understood that modifications and variations thereof are possible without departing from the scope of the claims of the present application.

What is claimed is:

1. Weapon system with a weapon and an aiming device with first and second spaced-apart elevation axes for aiming the weapon in elevation, wherein the aiming device has:

a trunnion bearing associated with the first elevation axis; and a loose bearing associated with the second elevation axis for mounting a weapon receptacle receiving the weapon.

2. The weapon system according to claim 1, wherein the loose bearing is arranged in front of the trunnion bearing in a firing direction of the weapon.

3. The weapon system according to claim 1, wherein the loose bearing is arranged in a firing direction of the weapon in a front region of the weapon receptacle; and/or the trunnion bearing is arranged in the firing direction of the weapon in a rear region of the weapon receptacle.

4. The weapon system according to claim 1, wherein at least one of the trunnion bearing or the loose bearing are arranged rotatably along an orbit about the associated first or second elevation axis.

5. The weapon system according to claim 4, wherein a radius of an orbit of the trunnion bearing about the first elevation axis is substantially equal to a radius of an orbit of the loose bearing about the second elevation axis.

6. The weapon system according to claim 4, wherein the trunnion bearing and/or the loose bearing is/are arranged rotatably over an angular range about the associated first or second elevation axis which is smaller than 360°.

7. The weapon system according to claim 1, wherein at least one of: the trunnion bearing has at least two trunnion bearing points between which the weapon receptacle is mounted; or the loose bearing has at least two loose bearing points between which the weapon receptacle is mounted.

8. The weapon system according claim 1, wherein the aiming device has at least one pivot element, which can be pivoted via at least one aiming drive, for aiming the weapon.

9. The weapon system according to claim 8, wherein the at least one pivot element extends between the first elevation axis and the trunnion bearing; or the at least one pivot element extends between the second elevation axis and the loose bearing.

10. The weapon system according to claim 8, wherein the at least one pivot element is configured to be decoupled from the aiming drive.

11. The weapon system according to claim 8, wherein the at least one pivot element is a pivot rod or a pivot disc.

12. The weapon system according to claim 11, wherein the trunnion bearing and/or the loose bearing is/are arranged on an outer circumference of a respective pivot element designed as pivot discs.

13. The weapon system according to claim 1, wherein the first and second elevation axes are arranged at a predetermined distance from a turret base, the distance from the turret base corresponding to at least one of: a length of a pivot element designed as a pivot rod; or a radius of a pivot element designed as a pivot disc.

14. A method comprising:

accessing a weapon of a weapon system with an aiming device having first and second spaced-apart elevation axes, wherein the aiming device has a trunnion bearing associated with the first elevation axis and a loose bearing associated with the second elevation axis for mounting a weapon receptacle receiving the weapon; and rotating at least one of the trunnion bearing or the loose bearing about the respective first or second elevation axis in order to aim the weapon.

15. The method according to claim 14, wherein the loose bearing is configured to allow translational movement of the weapon receptacle along a firing direction of the weapon, and wherein the trunnion bearing is configured to allow rotation movement of the weapon receptacle about an axis oriented perpendicular to the firing direction.

* * * * *